US006524514B1

(12) United States Patent
Volokitin et al.

(10) Patent No.: US 6,524,514 B1
(45) Date of Patent: Feb. 25, 2003

(54) METHOD AND DEVICE FOR PRODUCING FIBROUS MATERIALS FROM THERMOPLASTIC MATERIALS

(75) Inventors: Gennady G. Volokitin, Tomsk (RU); Vladmir V. Bordinov, Tomsk (RU)

(73) Assignee: Microfaser-Repro-GmbH, Gifhorn (DE)

( * ) Notice: Subject to any disclaimer, the term of this patent is extended or adjusted under 35 U.S.C. 154(b) by 0 days.

(21) Appl. No.: 09/582,788

(22) PCT Filed: Jan. 7, 1998

(86) PCT No.: PCT/DE99/00016

§ 371 (c)(1),
(2), (4) Date: Jul. 5, 2000

(87) PCT Pub. No.: WO99/35313

PCT Pub. Date: Jul. 15, 1999

(30) Foreign Application Priority Data

Jan. 7, 1998 (DE) ..... 198 00 297

(51) Int. Cl.[7] ..... D01D 5/08; D01D 5/18

(52) U.S. Cl. ..... 264/403; 264/211.1; 264/311; 264/404; 264/503; 264/555; 425/72.2; 425/425

(58) Field of Search ..... 264/211.1, 311, 264/403, 404, 503, 555; 425/72.2, 425

(56) References Cited

U.S. PATENT DOCUMENTS 4,323,523 A * 4/1982 Ueda et al. ..... 264/8

FOREIGN PATENT DOCUMENTS

DE 298 02 123 U 1 6/1998

OTHER PUBLICATIONS

Figure from RU 2093618 C1 (Oct. 20, 1997).*
Abstract Of USSR 699041 A (Nov. 28, 1979).
Abstract Of RU 2093618 C1 (Oct. 20, 1997).

* cited by examiner

*Primary Examiner*—Leo B. Tentoni
(74) *Attorney, Agent, or Firm*—Whitham, Curtis & Christofferson, PC

(57) ABSTRACT

The invention relates to a method for producing fibrous materials from thermoplastic material, wherein thermoplastic material is molten and fed into a rotating reactor to form a molten film and the fibers are formed on and stretched out along an open edge of the reactor. The fibers are formed on the reactor edge without using nozzles or ducts that are susceptible to clogging so that the rotating reactor is heated in such a way that the molten film has a temperature close to decomposition temperature of the thermic plastic material and the reactor is rotated on the edge at an orbital speed of no less than 10 m/s.

16 Claims, 3 Drawing Sheets

15
14

33
4
3
45
44
9
10
7
14
23
8
6
13
5
24
2
17
21
32
20
18
19
11
16
22

34
35
38
43
38
39
36
40
42
37
1
41

METHOD AND DEVICE FOR PRODUCING FIBROUS MATERIALS FROM THERMOPLASTIC MATERIALS

BACKGROUND OF THE INVENTION

1. Field of the Invention

The invention relates to a method for producing fibrous materials from thermoplastic materials, wherein the thermoplastic material is melted and fed into a rotating reactor for the formation of a molten film and the fibers are formed on and stretched out along an open edge of the reactor.

The invention also relates to a device for producing fibrous materials from thermoplastic materials with a melting apparatus for the thermoplastic material and a heated rotating reactor for forming of a molten film from the melted plastic, which exits the rotating reactor over an edge of an open side as fibers are formed.

2. Detailed Description of the Prior Art

Non-wovens made of fibrous materials of this type are used in particular for the absorption of petroleum, petroleum products and heavy metal ions from water. For especially effective nonwovens it is desirable for the fibers to have as small a thickness as possible.

The standard type of production of thermoplastic fibers is accomplished by melting down the starting thermoplasts and extruding the molten plastic through thin nozzles to form thin straight fibers. By stretching them out, the extruded fibers can be made even thinner, while they are simultaneously cooled down using a special airstream. These methods assume a very homogeneous starting thermoplast so that the use of recycling plastics, which are dishomogeneous and can contain foreign matter, is excluded from consideration. In particular, they would clog the nozzles. The extrusion processes also provide for working at relatively low temperatures, which can be only slightly higher than the melting temperature, in order to configure the cool-down measures following extrusion as simply as possible. By contrast, processing secondary raw materials and thermoplastic wastes requires high temperatures, which are close to thermoplastic decomposition temperatures.

Known in particular from SU 699 041 is the feeding of the themoplast melts to a revolving pot on the inner wall of which the molten film forms, and the stretch-spinning from the melted film is accomplished by the formation of fibers on the edge of the drum using a gas conducted over the molten film at high speed. The reactor here is designed in the form of a vertically positioned pot and consists of a hollow space and a work surface. Heated gas is fed under pressure to the interior hollow space of the reactor and the surface of the molten film. On the edge of the drum are slotted nozzles through which the molten film is divided up into individual streams and flows together with the heated gas. In this way the formed streams are made thinner and stretched out.

SUMMARY OF THE INVENTION

The object of the invention is to be able to create thin synthetic fibers that can be formed in high yields from high quality raw materials, but can also be formed from waste thermoplasts, all while avoiding the disadvantages of the known device.

To reach this goal, a method according to the invention of the type mentioned in the introduction is characterized in that the rotating reactor is heated so that the molten film has a temperature near the decomposition temperature of the thermoplastic material and in that the reactor is rotated at a belt speed of at least 10 m/s at its edge.

According to the invention, the reactor is thus heated itself so that the molten thermoplast is subjected to very constant temperature conditions, which can be selected close to the decomposition temperature for the thermoplasts without there being a risk of affecting the quality of the plastic stemming from particular localized areas exceeding this temperature, thereby leading to instances of decomposition. The fiber formation in the method according to the invention is a result of the high rotational speed or the high belt speed at the edge of the reactor, which causes the cohesive force of the molten film to be exceeded so that the division into fibers is accomplished. The use of channels or nozzles that are prone to clogging can therefore be completely done away with.

The fibers stretched out on the edge of the rotating drum are appropriately stabilized by the effect of an airstream that preferably runs transverse to the course of the fibers.

The thermal uniformity in the reactor required for the method according to the invention is supported in a preferred embodiment by the inner space of the reactor being closed off to a large extent by a cover forming a narrow circumferential gap with the edge. The gases that flow out when the molten film is heated up exit through the gap and positively influence the formation of fibers according to the invention. The cover is preferably fixedly positioned for this. It can be useful in this case for the cover to be positioned asymmetrically with respect to thereactor's axis of rotation to form a circumferential gap with a varying width.

With a smooth inner reactor surface the molten film could form spiral schlieren, thus irregular thicknesses. This can largely be prevented by subdividing the molten film on the inner reactor wall by means of axially oriented ribs.

To resolve the aforementioned problem, a device of the type mentioned in the introduction is also characterized in that the rotating reactor is heated from the outside and is sealed on its open side by an affixed cover up to a circumferential annular gap formed with the edge.

To strengthen the acceleration of the molten film, it is advantageous for the inner wall of the rotating reactor to expand conically toward the edge, whereby the reactor can neverthelessbe cylindrically shaped over the largest portion of its axial length.

The annular gap can preferably have a width of 15 to 20 mm, whereby the gap can be formed with a varying width by arranging the cover asymmetrically with respect to the rotating reactor's axis of rotation.

When the inner wall of the reactor is provided with axially oriented ribs to subdivide the molten film, according to a preferred embodiment of the invention, these are preferably configured with a triangular shape having its greatest height at the base of the reactor and having its lowest height at the end where the molten film exits. In connection with the preferred embodiment of a cylindrical reactor, which expands conically toward the open end, the ribs preferably extend over the cylindrical part of the reactor and terminate at the beginning of the conical part.

The reactor is heated up to its operating temperature from outside by means of a heater, which preferably can be a resistance heater, an induction heater or a magnetic induction heater.

DESCRIPTION OF THE DRAWINGS

The invention is explained in more detail below with reference to an embodiment illustrated in the drawings.

Shown are.

DETAILED DESCRIPTION OF THE PREFERRED EMBODIMENTS OF THE INVENTION

Figures 1, 1A:
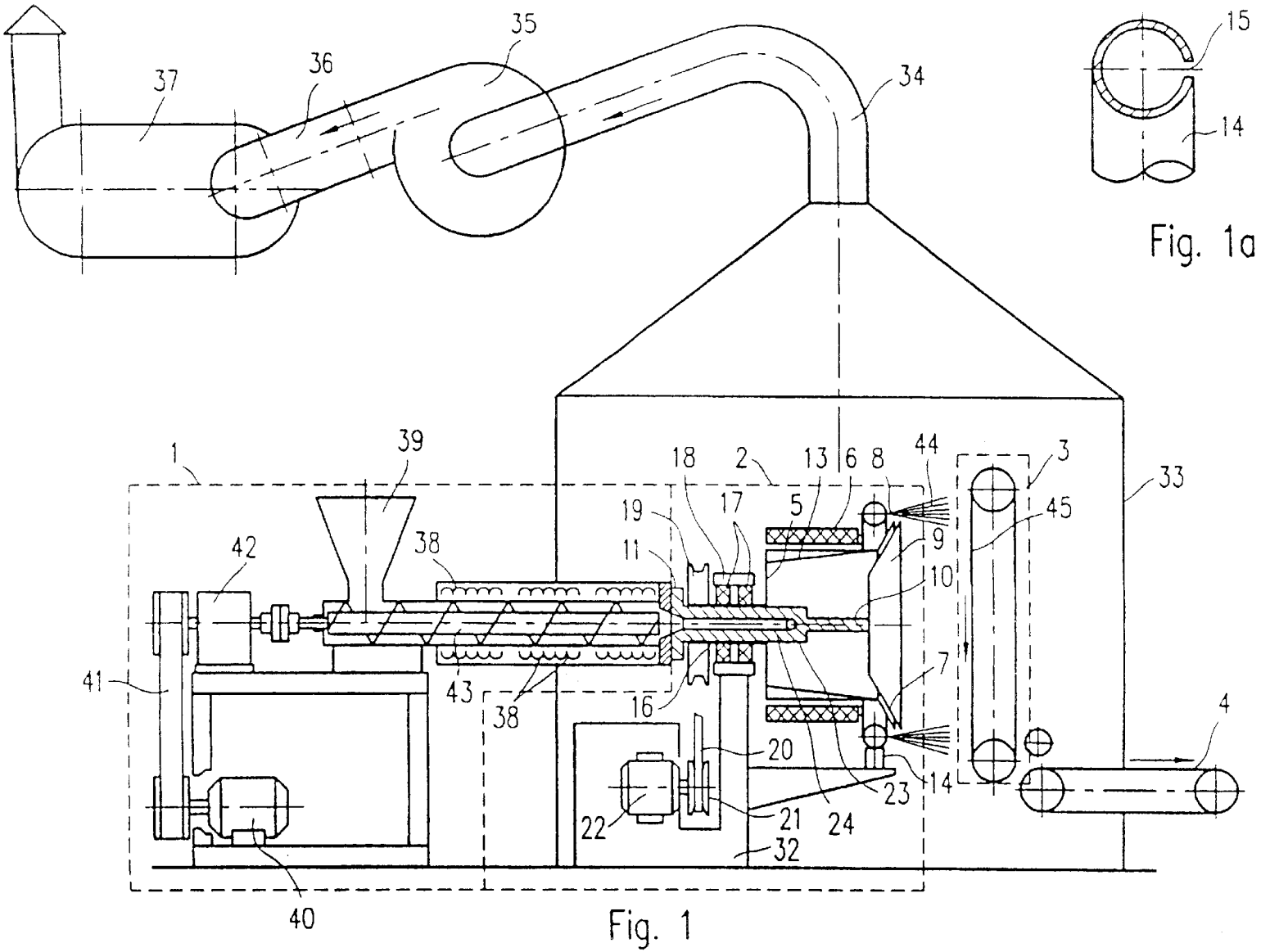
FIG. 1—schematic representation of a device according to the invention
Figure 2:
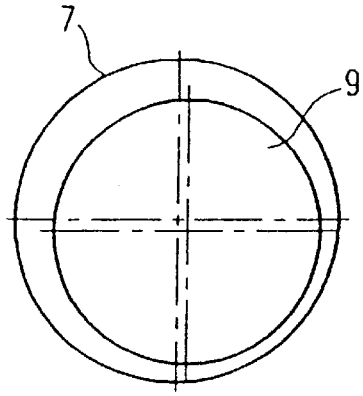
FIG. 2—plan view of the position of the cover relative to the edge of the reactor FIG. 3—two section views of a resistance heater FIG. 4—two section views of an induction heater and FIG. 5—two section views of a magnetic induction heater.

The device depicted in FIG. 1 shows all assembly groups of an extruder 1, a device for fiber formation 2, a unit for drawing off the finished fiber 3 and a take-off device 4.

The device for fiber formation 2 consists of a hollow rotating reactor 5, which is heated from outside with a reactor heater 6. The open side of the reactor 5 is designed with a conically expanded cone 7. An immovable cover 9 is installed in the cone 7 while forming an annular gap 8, said cover being fastened to a feed head 11 of the extruder 1 by means of a rod 10. The stationary cover 9 is arranged eccentrically to the contour of the conically expanding cone 7 and can be adjusted in its axial position by means of a threaded connection so that the gap 8 can be adjusted by means of the cover.

Ribs 13 with triangular surfaces are extended in the axial direction on the inner wall of the reactor 5. The ribs 13 are located on the entire casing surface of the reactor 5 in its cylindrical part. They have their greatest height at the base of the reactor 5 and are oriented with their lowest height (with their points) toward the exit of the melt. The exit end of the reactor 5 is encircled by an annular air channel 14 through which high-pressure air can exit from an opening 15 (FIG. 1*a*).

The reactor 5 is mounted at the end of a hollow shaft that is provided with ball bearings 17. The ball bearings 17 are located in a cooled housing 18. A drive wheel 19 of a belt drive 20 is mounted at the other end of the shaft 16, said belt drive 20 running by means of an output wheel 21 on the shaft of an asynchronous motor 22. A feeder crown 23 of a feed head 11 having a central opening 24 for the transport of molten product from the extruder 1 into the reactor 5 runs inside the hollow shaft 16.

The entire device for the fiber formation 2 is mounted on a separate frame 32 and placed in a protective chamber 33. An air line 34 connected with a low pressure fan 35 is attached in the upper part of the protective chamber 33. The low pressure fan 35 is connected on the output side by way of an air line 36 to a gas cleaning apparatus 37.

The extruder 1 has a reservoir tank 39 for a prepared thermoplast. A drive motor 40 drives a screw 43 of the extruder 1 by way of a belt drive 41 and a reduction gear 42. The screw is located in a housing with a barrel-shaped heater 38.

The apparatus is placed in operation by turning on the reactor heater 6 and the heater 38 as well as the low pressure fan 35 and the gas cleaning apparatus 37. Water is fed to the extruder 1 to cool the housing 18. The tank 39 of the extruder 1 is filled with the prepared thermoplast. After the setpoint temperature has been reached, the drive motor 22 for the rotation of the reactor 5 is switched on and the complex is allowed to run without product for 15 to 20 minutes to stabilize the operating temperature. After the operating temperatures of the device have been reached, the drive motor 40 of the extruder 1 is engaged and the drives of the unit switch on for the fiber draw-off 3 and the take-off device 4.

The drive motor 40 sets the screw 43 in rotary motion by way of the belt drive 41 and the reduction gear 42. The screw collects the thermoplast from the tank 39 and transports it to the feed head 11. Since the material is transported by the heated part of the extruder 11, it mixes and melts until it reaches the viscosity that corresponds to the thermoplast viscosity in the range of the decomposition temperature. Then the molten material enters the reactor 5 through the opening 24 of the crown 23 and of the feed head 11 where the same temperatures are maintained. In reactor 5 the melt is distributed over the perimeter of the inner wall and as a result of the centrifugal force is transported between the ribs 13 to the open end of the reactor 5. Since the thermoplast layer contacting the inner surface and the ribs 13 is pushed forward, it also rises, wherein a thin molten film results. Since the ribs 13 are built into the reactor 5, the melt does not move in a spiral pattern—which would in fact occur if there were a smooth.surface—but rather along the reactor generatrix. In this way the coating of the inner surface is accomplished much more evenly, thereby substantially increasing the quality of the melt. As the molten film from the cylindrical part of the reactor 5 ends up in the area of the conically expanded cone 7, its thickness is also reduced. In the process the gases generated in the reactor 5 as they exit bring about an even distribution of the molten film in the area of the cone 7. The molten film, due to the rotation of the reactor 5, maintains kinetic energy that is greater than the force of the surface tension. Therefore, the molten film divides into streams, pulls away of the edge of the cone 7 and stretches into fibers.

The production of the fibrous material in the manner according to the invention is only possible if the linear speed at the edge of the cone of the reactor 5 is higher than 10 m/s. The airstream 44 flowing out of the openings 15 of the annular air duct 14 influences the fibrous material in the process of stretching out. The fibrous material reaches the conveyor 45 of the unit for drawing off the fiber 3. With the conveyor belt 45, the fibrous material is transported to the take-off device, where the fibers are formed into finished goods.

The gases resulting for the creation of the fibrous material are routed from the protective chamber 33 through the air channels 34, and 36 using the low pressure fan 35 are routed into the gas cleaning apparatus 37.

The described device makes possible the production of the fibrous materials from thermoplasts with excellent absorption characteristics, whereby also industrial and household wastes can be utilized as raw material.

The reactor heater 6, which is installed outside the reactor 5, can be configured as a resistance heater 25, induction heater 26 or as a magnetic induction heater.

In all cases, these heaters 25, 26 and the reactor 5 are—thermally insulated with the outer casing 27.

Figure 3A:
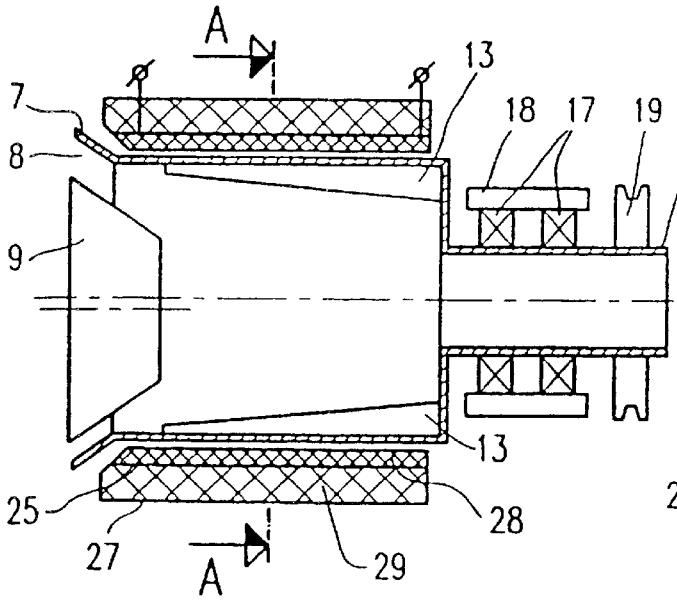
Figure 3B:
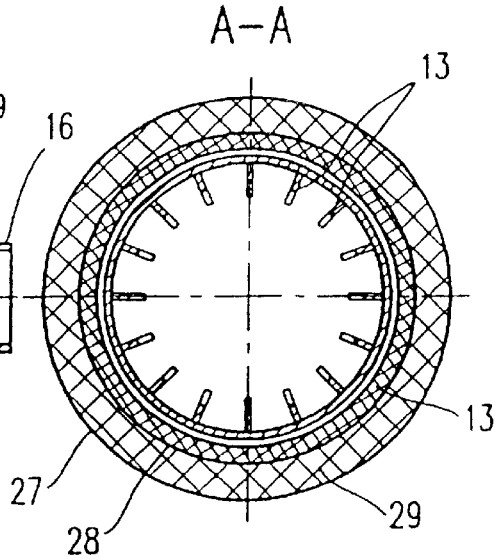

According to FIG. 3, the reactor heater 6 is configured as a resistance heater 25, which is located within a heat-resistant ceramic solid-construction housing 28. Housed between the electrical heater and the protective casing 27 is a thermal insulation material, e.g. ceramic fiber wadding.

Figure 4A:
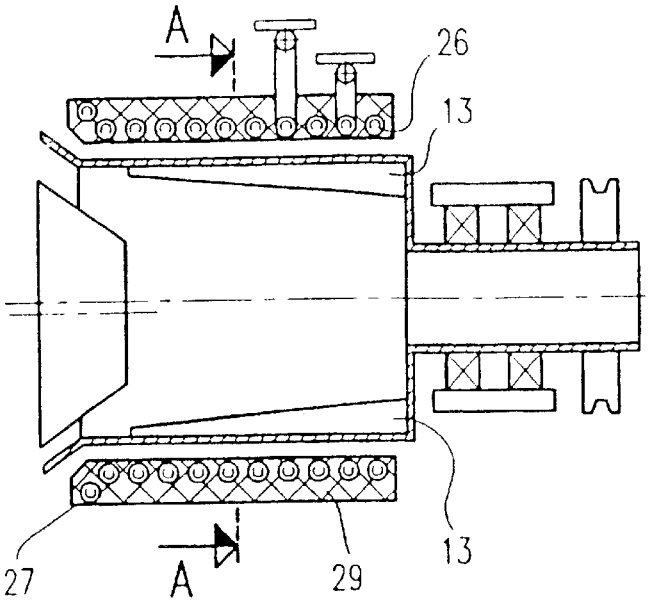
Figure 4B:
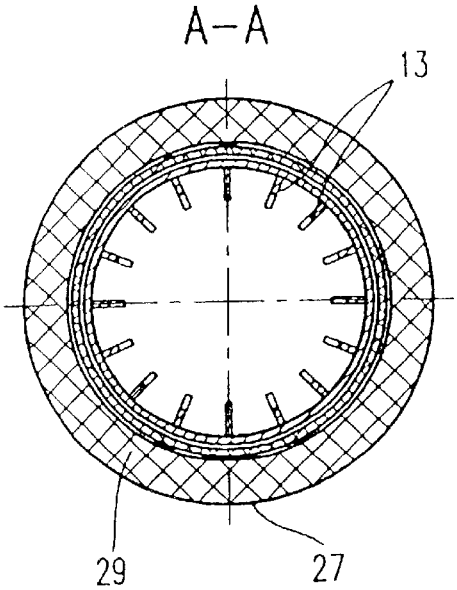

The variant according to FIG. 4 shows a reactor heater 6 as a induction heater 26 which can be cooled down and which is housed within the protective casing 27. Also here, the space between the heater 26 and the protective casing 27 is filled with thermal insulation material.

Figure 5A:
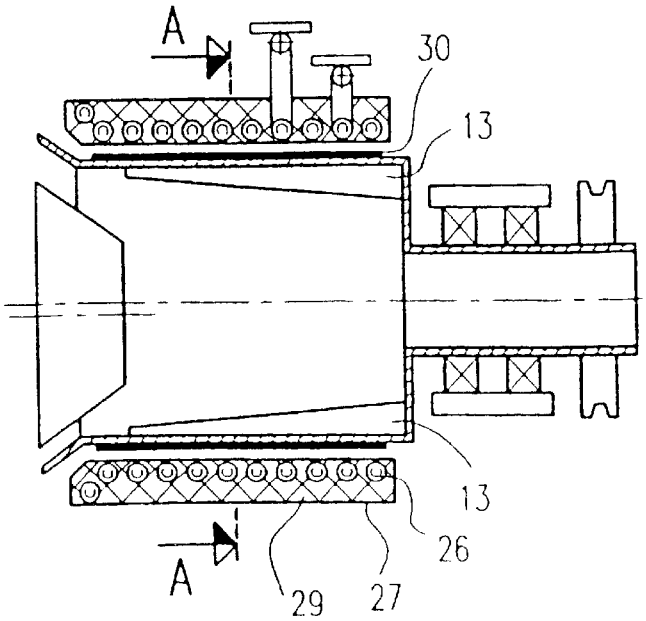
Figure 5B:
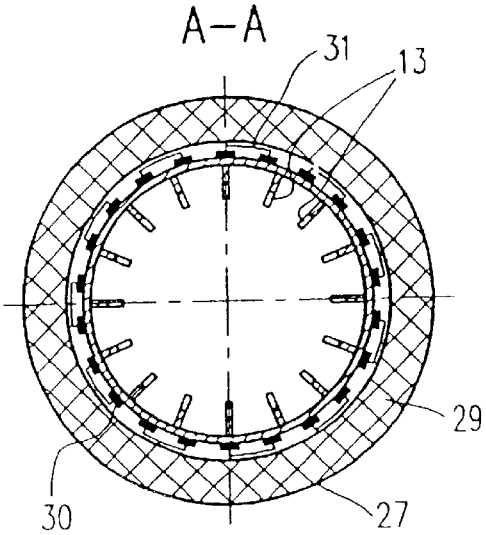

According to FIG. 5, the induction heater 26 contains additional plates 30 made of a ferromagnetic alloy (e.g. Ni—Co), which are attached along the reactor casing wall on the outer surface of the reactor 5 and connected with insulated conductors.

According to the method, the starting raw material is pre-melted and stirred in the extruder 1 resulting in a homogenous melt, the temperature of which is close to the decomposition temperature of the polymer. The melt is fed from the extruder 1 to the rotating reactor 5, the wall temperature of which is preheated to a temperature close to the decomposition temperature. Due to the rotation of the reactor 5, the melt is evenly distributed on the inner surface. In the process a paraboloid of the rotation forms, and it moves in response to the action of centrifugal forces in the direction of the open end. Since the open end of the reactor 5 has the form of a divergent cone 7, the thickness of the film is reduced in proportion to the expansion of the side surface. In this way it is possible to get thin fibers. After leaving the edge of the divergent cone 7, the film is divided into individual streams, which, due to the effect of centrifugal force and because of a high rotational speed of the reactor 5, change into fibers. The resulting fiber comes into the air-stream 44, which is oriented perpendicular to the dispersing fibers and thus forces the fibers into the unit 4 for drawing off the fibers. In the process the fiber stretches out and cools.

Since the film formation process occurs in a practically closed space, a gas medium with an excess pressure is produced inside the reactor 5. As a result decomposition processes can be reduced because of a lack of air.

Moreover, a stable temperature is created in the reactor 5. Therefore, possible fluctuations in the heat supply can be compensated for the process of the film formation. This leads to the reduction of energy costs in maintaining the specified temperature. The excess pressure in the interior of the reactor 5 leads to a gas flow, which for a certain time supplies the fiber with a heat sufficient for it to get even longer.

The application of the method according to the invention makes it possible to process high-grade fibers, not just with one sort of raw material, but with a combination of raw materials. This is because the raw material is first melted down and stirred in the extruder 1, and then remains inside the reactor for a certain time. As a result, the entire quantity is evenly heated up and the viscosity is controlled so that the production of the fiber proceeds from a homogenized melt.

In the event of a disturbance, due to which the melt does not reach the required viscosity, a self-cleaning of the reactor 5 is brought about by the centrifugal force.

The employment of thermostabilizers in dendrite form, which provides free ions, makes it possible to quickly suppress the processes involved in the decomposition of the polymers by bringing together free radicals of the torn up polymer chains. The result of this is an increase in the fiber quantity compared to the heavy metals and the expulsion of harmful substances into the environment is reduced.

EXAMPLE 1

The manufactured fibers have predominantly a thickness of 5 to 20 $\mu$m and are wound into intertwined fibers having a cross-sectional size in the range between 25 and 100 $\mu$m. The intertwining contains ball-like and drop-like particles that in part are coelesced with the fibers and in part are isolated from them. Moreover, there are numerous thickened segments of fiber the length of which is between three and ten times the crosssectional size of these thickened segments. The cross-sections of these thickened segments and the ball-like and drop-like particles lie in the range of 30 to 200 $\mu$m.

EXAMPLE 2

This is a coarse fiber example in which the majority of the fibers have a thickness of 50 to 400 $\mu$m. There is a lower quantity of thin fibers with a size of 5 to 20 $\mu$m. There are numerous ball-like and drop-like particles with a size of 50 to 300 $\mu$m.

EXAMPLE 3

The majority of the fibers have a cross-section of 1 to 10 $\mu$m. Coarser fibers with a thickness of 20 to 50 $\mu$m are present with thickened segments up to 100 $\mu$m. There are also ball-like and drop-like particles.

EXAMPLE 4

The majority of the fibers have a cross-section of 1 to 10 $\mu$m. A small number of the fibers have a size of up to 20 $\mu$m. The thicker fibers have thickened segments with a maximum cross-section of 50 to 150 $\mu$m. The ball-like and drop-like particles have a size of 100 to 400 $\mu$m.

The thickness and porosity of the fiber pattern in a loose arrangement without compaction was picnometric according to th& standard GOST 18955. I-73 makes a determination utilizing carbon tetrachloride as the picnometric liquid and the scale WLR-200, which have a measuring accuracy of ±0.05 mg. The data obtained are listed in Table 1.

TABLE 1

The density and porosity data with the loose arrangement at 20° C.

| | Number of the Pattern | | | |
|---|---|---|---|---|
| | 1 | 2 | 3 | 4 |
| The density, kg/m$^3$ | 911 | 903 | 907 | 909 |
| Pouring density, kg/m$^3$ | 102–117 | 167–174 | 112–127 | 123–136 |
| Porosity, % | 87.1–88.8 | 80.7–81.5 | 86.0–87.6 | 85.0–86.0 |
| Ratio of the pore area to the polymer area | 6.75–7.93 | 4.75–7.93 | 6.14–7.06 | 5.67–6.0 |

The absorption behavior of the fiber sample for the process of collecting petroleum and the petroleum products from the surface of the water with the repeated utilization of the material in the absorption-regeneration cycle was determined according to the following method.

The fiber pattern in the starting state permitted contacting the surface of the water, which contained a 3–6 mm thick layer of petroleum. West Siberian petroleum was used for the tests, and the industrial oil I-L-A-10 (GOST 20799-88) and the diesel oil of the brand 3-02 (GOST-305-82) were each used as a petroleum product.

The degree of saturation of the material with the liquids was checked according to the weighing method. Then the sample saturated with petroleum (or petroleum product) was centrifuged with the separation factor of 100±3. The content of the petroleum (or petroleum product) remaining in the fibers was determined according to GOST 6370-83. The centrifugate was dehydrated with copper sulphate according to GOST 26378.0-84 and then the petroleum (or petroleum product) content was determined according to GOST 6370-83. The ratio of the mass of petroleum absorbed in the given process before and after centrifuging to the mass of the sample to be tested was determined based on the data obtained. The results are given in tables 2 and 3.

TABLE 2

Absorption capacity of Example 4 in relation to the industrial oil I-L-A-10 and the diesel oil 3-02 with repeated cycles of saturating the fibrous material with the petroleum products (Absorption - Regeneration)

| Number of the absorbtion-regeneration cycle | Ratio of the mass of the petroleum product to the mass of the fibers for: Industrial | | Diesel Oil | |
|---|---|---|---|---|
| | Before centrifuging | After Centrifuging | Before Centrifuging | After Centrifuging |
| 1 | 12.99 | 0.376 | 9.95 | 0.132 |
| 2 | 8.54 | 0.409 | 7.28 | 0.195 |
| 5 | 7.97 | 0.446 | 7.22 | 0.201 |
| 10 | 7.75 | 0.443 | 6.27 | 0.204 |
| 15 | 7.913 | 0.454 | 6.31 | 0.210 |
| 20 | 7.82 | 0.451 | 6.22 | 0.215 |

The absorption capacities of the known materials that are used for collecting hydrocarbon liquids (g/g): lignin—2.2; peat—2.6–7.7; filter perlite—7.0–9.2; asbestos (with fraying)—5.86.4; dornite—1.9–2.5, technical wadding—7.0–7.2. One must take into consideration here that all of these known materials are only disposable materials. The studies conducted with the materials mentioned have shown that they possess properties that enable them to be used for picking up petroleum and petroleum products from the surface of water.

Among these properties are:

Hydrophobic, good dampening with petroleum and petroleum products;

their density is lower than the density of water, which affects the buoyancy of these materials;

high porosity of the materials;

high absorption capacity of the materials, in relation to petroleum and petroleum products even after the twentieth cycle of use;

"flat" decrease characteristic of the absorption capacity after repeated absorption-regeneration cycles;

high degree of removal of the absorbed liquid from the material in the centrifugal force field (90–98%).

TABLE 3

Absorption capacity of the fiber pattern for West Siberian petroleum in repeated petroleum absorption-regeneration saturation cycles

| Number of the absorption-regeneration cycle | Ratio of the mass of the absorbed petroleum to the mass of the fibers, g/g for the pattern: Example I | | Example 2 | | Example 3 | | Example 4 | |
|---|---|---|---|---|---|---|---|---|
| | before centri-fuging | after centri-fuging | before centri-fuging | after centri-fuging | before centri-fuging | after centri-fuging | before centri-fuging | after centri-fuging |
| 1 | 8.76 | 0.235 | 6.09 | 0.160 | 7.84 | 0.428 | 9.31 | 0.407 |
| 2 | 8.72 | 0.307 | 6.58 | 0.175 | 5.61 | 0.558 | 7.03 | 0.267 |
| 5 | 7.97 | 0.462 | 6.71 | 0.183 | 5.34 | 0.513 | 6.08 | 0.357 |
| 10 | 7.18 | 0.386 | 7.35 | 0.165 | 3.80 | 0.501 | 5.89 | 0.352 |
| 15 | 6.73 | 0.285 | 7.68 | 0.165 | 3.52 | 0.558 | 6.03 | 0.459 |
| 20 | 6.75 | 0.343 | 7.63 | 0.148 | 3.46 | 0.733 | 5.79 | 0.500 |

The absorption capacity of the fibrous material is indicated in Table 4. The fibrous material is produced on the experimental apparatus from the wastes of polypropylene of the brand (21030–21060)-60 with the thermal stabilizer titanium dioxide with particle size 3–5 $\mu$m with the content 1% by weight.

To purify water of iron (III) with the starting content of the iron (III) at 10 mg/l in the solution, fiber patterns with a fiber arrangement density of 260 kg /m$^3$ were used in the filter.

TABLE 4

Absorption capacity of the fibrous material in the process of water purification of ions of iron III.

| N | Final concentration of iron, Ci, mg/I | Degree of purification $1\frac{C_1}{C_0}100\%$ |
|---|---|---|
| 1 | 2 | 3 |
| 1 | 0.40 | 99.60 |
| 2 | 0.36 | 99.64 |
| 3 | 0.35 | 99.65 |
| 4 | 0.41 | 99.59 |
| 5 | 0.33 | 99.67 |
| 6 | 0.29 | 99.71 |
| 7 | 0.28 | 99.72 |
| 8 | 0.25 | 99.75 |
| 9 | 0.24 | 99.76 |
| 10 | 0.20 | 99.80 |

We claim:

1. Method of producing fibrous materials from thermoplastic materials, comprising the steps of:

melting and feeding the thermoplastic material into a rotating reactor having cylindrical side walls for forming a molten film on said side walls;

heating the cylindrical side walls from their outside to a temperature close to the decomposition temperature of the thermal plastic material which is sufficient to maintain a viscosity in the range of the decomposition temperature; and rotating the reactor with a path speed of at least 10 m/s at its edge.

2. Method according to claim 1, wherein the inner space of the reactor restricted by a cover forming a narrow gap with the edge.

3. Method according to claim 2, wherein the cover is positioned asymmetrically with respect to the axis of rotation in order to form a circumferential gap with varying width.

4. Method according to claim 1, wherein the molten film is subdivided on the inner wall of the reactor by axially oriented ribs.

5. Method according to claim 1, wherein the fibers that are forming are subjected to an airstream.

6. Method according to claim 5 wherein the airstream is directed transverse to the fibers exiting the reactor.

7. Method according to claim 1 wherein at least one disperser mineral aggregate with a dendrite particle form is added.

8. Device for producing fibrous material from thermoplastic material, comprising:

a melting apparatus for the thermoplastic material;

a rotating reactor having cylindrical side walls for forming a molten film from molten plastic material;

an open side of the rotating reactor forming a circular edge over which the molten plastic film exits the rotating reactor in a form of fibers;

a reactor heater arranged outside the rotating reactor and heating the side walls of the rotating reactor to a temperature close to the decomposition temperature of the thermoplastic material which is sufficient to maintain a viscosity in the range of the decomposition temperature; and a stationary cover forming a circumferential annular gap with said edge of the rotating reactor.

9. Device according to claim 8 wherein the inner wall of the rotating reactor is conically expanded toward the edge.

10. Device according to claim 9 wherein the reactor is cylindrically configured over the majority of its axial length.

11. Device according to claim 8 wherein the annular gap has a width of about 15 to 20 mm.

12. Device according to claim 8 wherein the cover is arranged asymmetrically with respect to the axis of rotation of the rotating reactor, so that the annular gap is configured with a varying width.

13. Device according to claim 8 wherein the reactor has on its inner wall a multiplicity of axially oriented ribs to subdivide the molten film.

14. Device according to claim 13 wherein the ribs are configured as triangular in the longitudinal direction with their greatest height at the base of the reactor and with their lowest height at the end where the molten film exits.

15. Device according to claim 10 wherein the ribs terminate at the end of the cylindrical part of the reactor.

16. Device according to claim 8 wherein the reactor is encircled at its exit end by an annular air channel that has an annular exit gap directed in the axial direction of the reactor.

* * * * *

UNITED STATES PATENT AND TRADEMARK OFFICE

CERTIFICATE OF CORRECTION

PATENT NO. : 6,524,514 B1
DATED : February 25, 2003
INVENTOR(S) : Volokitin et al.

It is certified that error appears in the above-identified patent and that said Letters Patent is hereby corrected as shown below:

Title page,
Item [75], Inventor, the name of the second inventor should be spelled the following way: -- Vladimir V. Bordunov, Tomsk (RU) --

Signed and Sealed this

Eighth Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,524,514 B1 
DATED : February 25, 2003
INVENTOR(S) : Gennady G. Volokitin and Vladimir V. Bordunov It is certified that error appears in the above-identified patent and that said Letters Patent is hereby corrected as shown below:

Title page,
Item [22], change "PCT Filed: Jan. 7, 1998" to -- PCT Filed: Jan. 7, 1999 --

Signed and Sealed this

Twenty-sixth Day of August, 2003

JAMES E. ROGAN
*Director of the United States Patent and Trademark Office*